United States Patent [19]

Goldenberg

[11] 4,240,321

[45] Dec. 23, 1980

[54] KEYBOARD ASSEMBLY FOR TOY MUSICAL INSTRUMENTS

[75] Inventor: J. Melvyn Goldenberg, Upper Saddle River, N.J.

[73] Assignee: Proll Molding Company, Bloomfield, N.J.

[21] Appl. No.: 44,504

[22] Filed: Jun. 1, 1979

Related U.S. Application Data

[62] Division of Ser. No. 889,984, Mar. 24, 1978, Pat. No. 4,168,649.

[51] Int. Cl.[3] ..... G10C 3/12; G10D 13/08

[52] U.S. Cl. ..... 84/433; 84/404

[58] Field of Search ..... 84/433–437, 84/402–404

[56] References Cited

U.S. PATENT DOCUMENTS

| | | | |
|---|---|---|---|
| 1,285,299 | 11/1918 | Marx | 84/404 |
| 1,745,265 | 1/1930 | Mecera | 84/435 |
| 2,293,101 | 8/1942 | Berger | 84/404 |
| 2,837,004 | 6/1958 | Volpe | 84/404 |
| 2,902,897 | 9/1959 | Volpe | 84/404 |
| 3,512,442 | 5/1970 | Sjö strand | 84/433 |
| 3,745,874 | 7/1973 | Martin et al. | 84/433 |

*Primary Examiner*—Lawrence R. Franklin
*Attorney, Agent, or Firm*—Martin P. Hoffman

[57] ABSTRACT

The keys for toy musical instruments comprises a plurality of keys that are friction-fitted on a pair of supports. Each key is an integrally formed, molded member comprised of several components with interrelated functions, such as (1) a key lever for manual depression, (2) a hammer at the end remote from the key lever, (3) a flexible segment for propelling the hammer against a tone bar in response to depression of a key lever, and (4) unique cooperating members on the flexible segment and key lever for damping out reverberations of the hammer that might cause repeated strikings of the tone bar and/or chattering of the hammer.

5 Claims, 6 Drawing Figures

KEYBOARD ASSEMBLY FOR TOY MUSICAL INSTRUMENTS

This is a division of application Ser. No. 889,984 filed Mar. 24, 1978, now U.S. Pat. No. 4,168,649.

BACKGROUND OF THE INVENTION

1. Field of the Invention

The instant invention relates generally to toy musical instruments, such as pianos and similar key operated instruments, and more particularly pertains to refinements in the configuration of the plurality of keys utilized the keyboard assembly employed within such instruments.

2. Prior Art

The manufacturing and assembling of the several components of the keyboard assembly represents a major cost factor in the production of toy musical instruments, such as pianos. Accordingly, when faced with rapidly escalating costs of raw materials and labor, toy manufacturers have sought, inter alia, new designs for the keyboard assembly that will enable the continued production of an attractive product at a competitive price. Thus, numerous innovative keyboard designs have been proposed, and a lesser number have been developed, reflecting the keen competition within the toy instrument industry.

One simplified keyboard assembly is shown in U.S. Pat No. 2,837,004, granted June 3, 1958 to Daniel J. Volpe. Such patent discloses die-formed sheet metal keys which have apertures defined in their sidewalls, so that a laterally extending metal rod can be passed therethrough. Grommets are assembled on the rod and then snapped into the holes; the grommets serve as bearings for the keys and also laterally align the keys with respect to one another.

An even simpler keyboard assembly, executed in plastic, is shown in U.S. Pat. No. 3,057,244, granted Oct. 9, 1962 to Charles Pearson. Such patent discloses a base 10 having a lower section with a series of spaced, key supports 12 and an upper section for seating a plurality of tone bars 40. As shown in FIG. 4 of Pearson, a key 44 is secured to each support for pivotal movement and a hammer 54 is situated at the rear end of the key to strike a tone bar disposed thereabove.

Another keyboard assembly, which was designed principally for full sized musical instruments but which may have applicability to toy musical instruments, if cost considerations can be met, is shown in U.S. Pat. No. 3,512,442 granted May 19, 1970 to Gunnar O. Sjostrand. Such patent depicts a pivotally mounted key 1 that has a resilient tongue 2 attached to its upper surface. A hammer is secured to the free end of the tongue, and, when the key is depressed, the hammer is propelled against string 4 to produce a sharp, clean tone. Since the rear surface of the key is beveled and a sound damping coating 8 may be applied thereto, the tonal quality of the instrument is greatly enhanced and the undesirable reverberation of the hammer will be eliminated.

All of the keyboard assemblies discussed above suffered from one or more shortcomings. For example, the sheet metal keys proposed by Volpe necessitated the use of grommets snapped into apertures on the sidewalls of each key to attain proper alignment upon a common shaft; also a separate wooden striker was secured to the rear of the key lever to serve as a hammer for striking the tone bars. No provision was made to dampen unwanted vibrations of the hammer. While Pearson proposed a molded plastic keyboard assembly with discrete key supports that was far simpler to assemble than the Volpe keyboard assembly, Pearson did not address the problem of damping unwanted vibrations of the hammer.

While the beveled key surface and sound dampening coating of Sjostrand did provide for the elimination of unwanted vibrations, such solution was costly and therefor not readily applicable to mass produced, relatively inexpensive toy musical instruments. Also, the key lever, resilient tongue and hammer were formed as distinct components that were subsequently joined together by known fasteners. However, the costs of forming and joining together these distinct components further added to the costs of the Sjostrand keyboard assembly.

Diverse other keyboard assemblies have been proposed, including sundry attempts to produce an integrally formed key capable of performing multiple efforts. None of these assemblies has achieved wide spread commercial success.

SUMMARY

Thus, with the deficiencies of known keyboard assemblies for toy musical instruments clearly in mind, the instant invention contemplates a keyboard assembly, executed in plastic, that can be readily fabricated, quickly assembled, and is characterized by a plurality of unique, integrally formed keys that satisfactorily perform the functions previously associated with several distinct components. Furthermore, the cost savings realized by the instant keyboard assembly enable the production of a reasonably priced, toy musical instrument with enhanced tonal quality.

In furtherance of these goals, it is an object of the instant invention to design a molded plastic key comprising a key lever, a hammer at the end remote from the key lever, a flexible segment for propelling the hammer against a tone bar in response to depression of the key lever, and cooperating means on the key lever and flexible segment for damping out reverberations of the hammer.

It is a further object of the invention to provide a base including a plurality of discrete, upstanding columns for receiving a like plurality of keys. Each key has a pair of supports on its underside for frictional securement to a column so that the key can be pivoted relative thereto, and each column is formed of two resilient halves spaced apart by a narrow gap. The two resilient halves, in essence, perform a dual function, (1) retaining the key securely in place without relying upon external fasteners, and (2) assisting the key in returning to its normal horizontal orientation after the key has been depressed.

It is yet a further object of the invention to provide a plastic key with continuous depending sidewalls that can be readily molded and easily separated from the mold, said key being assembled to a column and yet maintaining its lateral alignment relative to the other keys in the keyboard assembly.

Furthermore, it is an object of the invention to provide a plastic key with a barrier on its upper surface that contributes to the esthetic appeal of the assembled toy instrument.

Additionally, the keyboard assembly of the present invention is sturdy, can be screwed into position within the shell of diverse toy instruments, can be molded with a minimum number of rejects, and readily lends itself to mass production techniques.

Other objects and advantages attributable to the instant keyboard assembly will become readily apparent to the skilled artisan when the following specification is read in harmony with the appended drawings.

BRIEF DESCRIPTION OF PREFERRED EMBODIMENT

Figure 1:
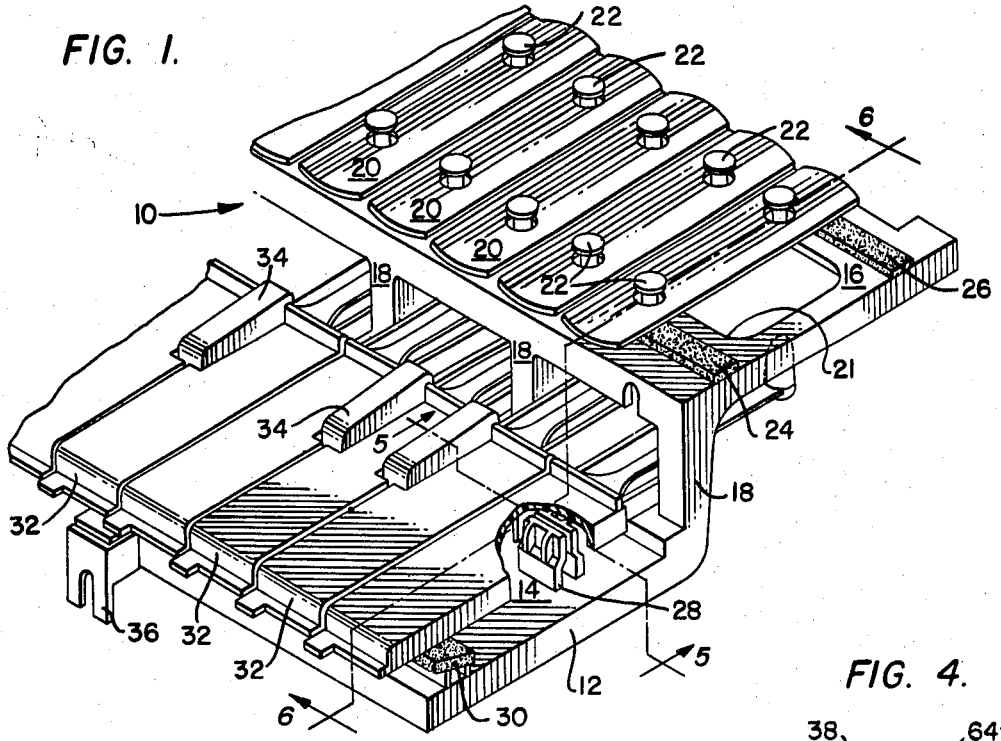
FIG. 1 is a perspective view of a fragment of a keyboard assembly constructed in accordance with the principles of the instant invention.

Turning now to the drawings, FIG. 1 illustrates a keyboard assembly 10 constructed in accordance with the principles of the instant invention. The shell of the toy musical instrument has been removed to reveal that the assembly 10 includes a base 12 with a lower section 14 and an upper section 16, the sections being interconnected by vertical posts 18. The base 12 and its various sections are integrally formed by a plastic molding operation.

A plurality of tone bars 20 extend across the several openings 21 in the upper section 16 of the base, and rivets 22, or other known fasteners, pass through the tone bars and retain same in position on the base. Felt strips 24, 26 extend laterally across section 16 and straddle the openings 21; the strips minimize the unwanted vibrations of the tone bars. Each tone bar 20, when struck, produces a distinctive note.

A plurality of discrete columns 28 extend upwardly from the lower section of base 12, and a felt strip 30 extends laterally across the base 12. A plurality of whole-note keys 32 are secured to the columns for pivotal movement; each key is removably secured to its own column. Interspersed within keys 32 are black keys 34 which represent the half-notes in the scale; however, in the interest of economy, the black keys are formed by hollow protusions extending upwardly from the base 12. Although immobile, the dummy keys 34 enhance the realistic appearance of the keyboard and assist in the lateral alignment of keys 32. A post 36 with a pair of legs is situated on the front edge of the lower section of base 12; the post is representative of several posts spaced about the assembly 10 which enable the assembly to be screwed into fixed engagement with the shell or housing of diverse toy instruments.

Figure 2:
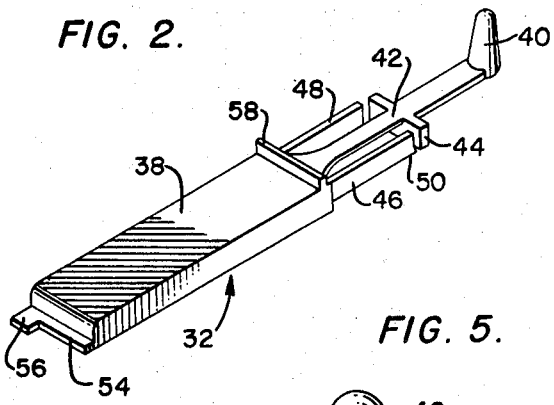
FIG. 2 is a perspective view of a key employed within said keyboard.
Figure 3:
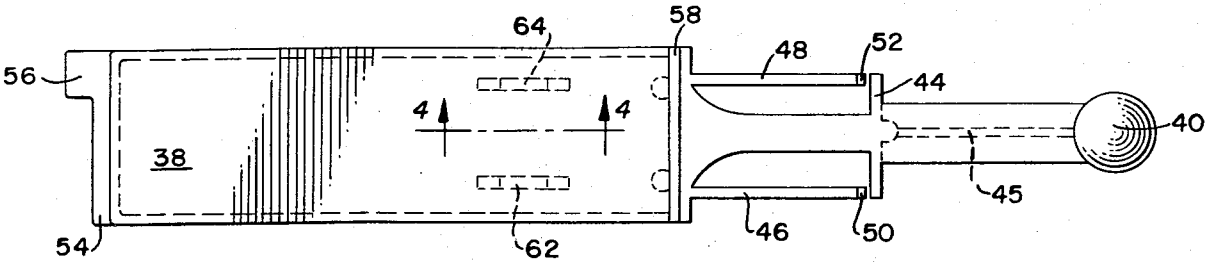
FIG. 3 is a top plan view of the key shown in FIG. 2 and 6, such view being taken along line 3—3 in FIG. 6 and in the direction indicated.

FIGS. 2 and 3 depict the structural details of a key 32 of the plurality of identical keys employed in the keyboard assembly. Each key 32 includes a key lever 38 at its front end, a hammer 40 at the end remote from the key lever 38, and a thin flexible segment 42 interconnecting the key lever and the hammer. As seen with greater clarity in FIG. 6, when the key lever 38 is manually depressed about its fulcrum point, i.e., column 28, the thin flexible segment 42 whips, or propels, the hammer 40 against the particular tone bar 20 disposed on the upper section of the base in proximity to the key 32.

A stop bar 44 extends transversely to the segment 42, and a reinforcing rib 45 extends between the stop bar and the hammer 40. Spaced rails 46, 48 extend rearwardly from the key lever, and abutments 50, 52 project rearwardly from the rails. After the hammer 40 has struck the tone bar, the hammer rebounds beyond its normal position. The amount of rebound is sharply limited, however, by the engagement of stop bar 44 with abutments 50, 52 and the hammer 40 does not repeatedly strike the tone bar and/or chatter. Thus, the undesired reverberations encountered in conventional toy musical instruments are eliminated and tonal quality is improved.

A ledge 54 extends forwardly from key lever 38, and a tab 56 projects forwardly from the ledge. The tab 56 cooperates with the housing of the toy musical instrument to define a normal, or unactuated, home position for each key 32. A barrier 58 is situated on the upper surface of the key lever 38. The depending walls of the key lever 38 are unbroken and define a downwardly opening chamber 60 on the underside of the key lever. A pair of spaced supports 62 and 64 are situated within the chamber 60. It will be appreciated, however, that all of the above described components of the key 32 are integrally formed in a single molding operation.

Figure 4:
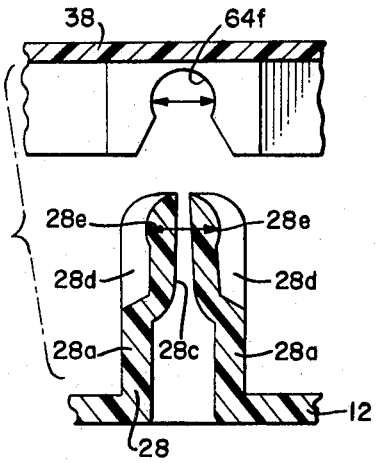
FIG. 4 is an enlarged, side elevational view of a fragment of a key prior to securement to the base of the keyboard assembly, such view being taken along line 4—4 in FIG. 3 and in the direction indicated.

FIG. 4 shows the manner in which each key 32 is removably secured to a column 28 on the base of the keyboard assembly. Each column 28 is formed of a front half **28*a*, and a rear half 28*b*; the halves are separated by a gap 28*c*. Locator ribs 28*d*, visible in FIG. 1, are defined on each column half; the ribs coact with the supports 62, 64 to lock the keys 32 to the columns 28. The column halves are resilient and can be pressed toward each other to reduce the size of the gap as the supports 62 and 64 on each key are forced thereover. Arcuate sectors 28*e* are formed on the column halves, and the supports 62, 64 are undercut, as at 64*f*, to receive the arcuate sectors when the keys 32 are friction-fitted onto the columns 28. The radial distance between the undercuts 64*f* on the supports is slightly less than the radial distance between the arcuate sectors 28*e* on each column 28. Thus, the keys are friction-fitted onto the column 28 to press the column halves toward each other, and are removably retained thereon for pivotal motion relative to the column, which serves as a fulcrum. At the same time, the keys 32** are securely joined to the discrete columns in lateral alignment.

The column halves **28*a*, 28*b*, in addition to retaining each key 32 securely in place, assist each key in returning to its normal horizontal orientation after the key has been depressed. By a judicious selection of angles in the undercut 64*f* for each key relative to the curvature of sectors 28*e*, the column halves are pressed together as the front end of a key is depressed. When the finger pressure is released, the column halves tend to move apart to re-establish the gap 28*c***, and in so doing, a restoring force is supplied to the key.

Figure 5:
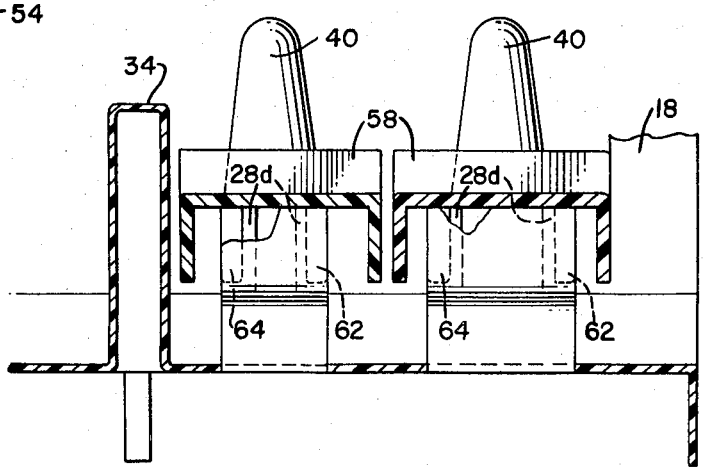
FIG. 5 is a vertical cross-sectional view through a pair of adjacent keys and the base of the keyboard assembly, such view being taken along line 5—5 in FIG. 1 and in the direction indicated.

FIG. 5 shows a pair of keys 32 mounted upon a like pair of discrete, resilient columns 28. The supports 62, 64 for each key 32 are friction-fitted into engagement with its respective column 28 outboard of the locator ribs 28*d* on the column. The barrier 58 on each key 32 is also visible in FIG. 5; such barrier blocks the vision of the child playing the instrument from observing the internal mechanism in much the same manner as the internal operation of a full-sized piano is hidden from view.

Figure 6:
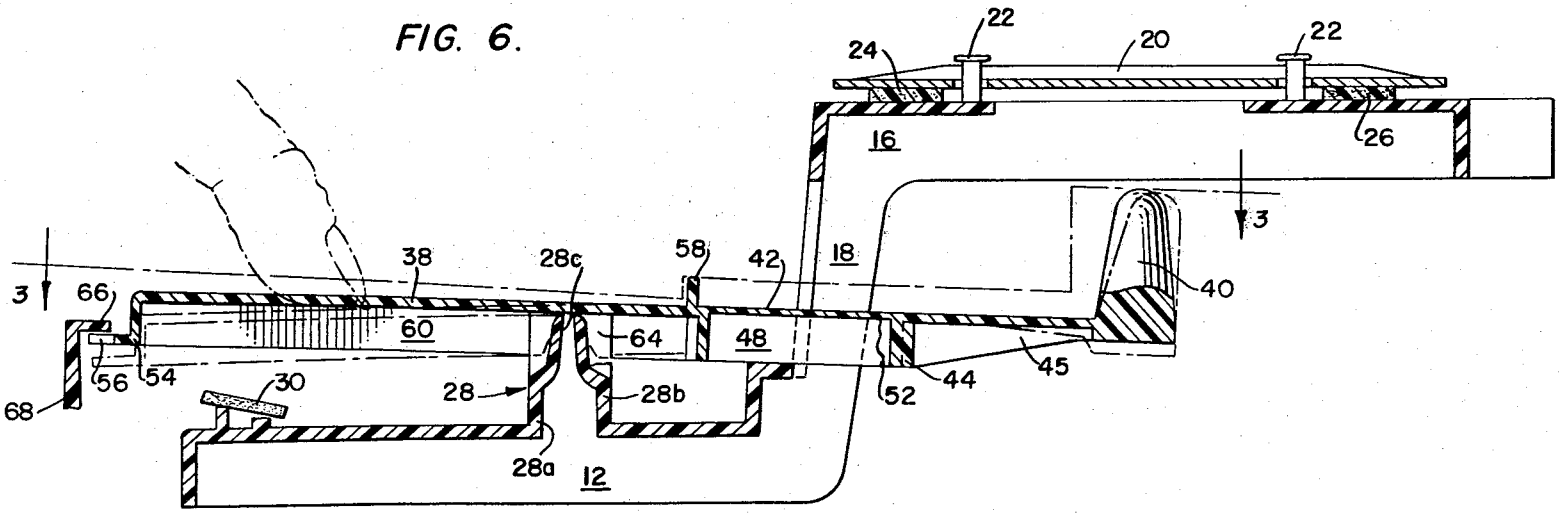
FIG. 6 is a side elevational view through a key and the base of the keyboard assembly, such view being taken, on an enlarged scale, along line 6—6 in FIG. 1 and in the direction indicated.

FIG. 6 reveals that manual depression of key lever 38 causes the pivotal movement of key 32 about column 28, which, in turn, causes the hammer 40 to be propelled upwardly against the tone bar. The section intermediate the key lever 38 and the hammer 40 is the thinnest section of the key; as the key lever is depressed, the section yields slightly and momentarily lags behind the movement of the key lever. However, in a split-second, the intermediate section recovers and quickly whips or propels the hammer against the tone bar 20 operatively associated therewith to sound the selected note. The whipping action of the intermediate section, however, produces a tendency in the hammer to rebound and/or reverberate and strike the tone bar again, thus producing a tone of poor quality. Alternatively, the hammer tends to chatter against the base of the keyboard assembly. However, since the stop bar 44 strikes abutments 50, 52 and quickly dissipates the excess energy in the resilient intermediate section, the tendency to repeatedly strike the tone bar 20 is overcome by the instant keyboard assembly.

The tab 56 on the front of the key lever 38 fits under the front lip 66 on the housing 68 of the toy musical instrument. The tab and the housing maintain the keys in a horizontal plane.

While a preferred embodiment of the instant keyboard assembly has been shown and described, numerous variations and modifications will occur to the skilled artisan. For example, if the keys and columns can be molded and assembled within close tolerances that will eliminate reverberations, felt strips 24, 26 may be omitted; the same may hold true for the felt strip 30 secured to the base under the keys. Also, the tab 56 on the front of the key and/or the lip 66 on the housing of the instrument may prove to be superfluous. Consequently, the appended claims should not be limited to their literal terms, but should be broadly construed in a manner consistent with the thrust of the inventive effort.

I claim:

1. A key adapted to be used in a keyboard assembly of a toy musical instrument, said key comprising:

(a) a key lever;

(b) a hammer spaced from the key lever;

(c) a flexible segment intermediate said key lever and said hammer;

(d) means on said key lever adapted to secure the key in position within the instrument; and the invention comprising:

(e) cooperating means defined between the flexible segment and said key lever for damping out reverberations of the hammer, said cooperating means including a stop bar formed on said flexible segment and a pair of rails projecting rearwardly from said key lever.

2. A key as defined in claim 1 wherein said key lever, said hammer, said flexible segment, said securing means, and said cooperating means are all integrally formed, molded plastic components.

3. A key as defined in claim 1 wherein abutments extend rearwardly from said rails, said abutments cooperating with said stop bar to dissipate excess energy in said flexible segment.

4. A key as defined in claim 3 wherein said stop bar extends transversely across the flexible segment and depends therebelow.

5. A key as defined in claim 3 wherein a barrier is formed on the upper surface of the key lever.

* * * * *